US007290984B2

(12) United States Patent
Volk

(10) Patent No.: US 7,290,984 B2
(45) Date of Patent: Nov. 6, 2007

(54) MULTISTAGE PUMP

(75) Inventor: James J. Volk, Fort Wayne, IN (US)

(73) Assignee: Franklin Electric Co., Ltd., Bluffton, IN (US)

( * ) Notice: Subject to any disclaimer, the term of this patent is extended or adjusted under 35 U.S.C. 154(b) by 352 days.

(21) Appl. No.: 11/138,124

(22) Filed: May 26, 2005

(65) Prior Publication Data

US 2006/0269404 A1 Nov. 30, 2006

(51) Int. Cl.
*F01D 11/00* (2006.01)

(52) U.S. Cl. ..... 415/199.2

(58) Field of Classification Search ..... 415/198.1, 415/199.1, 199.2, 199.3, 211.2
See application file for complete search history.

(56) References Cited

U.S. PATENT DOCUMENTS 2,429,978 A * 11/1947 Blanchard ..... 415/120
5,133,639 A * 7/1992 Gay et al. ..... 415/170.1
6,106,224 A * 8/2000 Sheth et al. ..... 415/104
6,899,517 B2 * 5/2005 Gay et al. ..... 415/104

* cited by examiner

*Primary Examiner*—Edward K. Look
*Assistant Examiner*—Devin Hanan
(74) *Attorney, Agent, or Firm*—Gardere Wynne Sewell LLP

(57) ABSTRACT

A centrifugal pump includes plural pump stages, each comprising an impeller assembly, a stationary disc assembly and a diffuser assembly, all disposed about an impeller shaft. A floating impeller hub seal is supported by a diffuser assembly to minimize fluid recirculation. A thrust washer is disposed around the impeller shaft and is engageable with an impeller hub and the hub seal. A wear ring is secured to a disc assembly and engageable with a wear surface on the impeller.

20 Claims, 5 Drawing Sheets

3/5
176
150
188
174
186
188
172
173c
173b
173d
173a
173a
173
170
184
180
180
182
178
180

210
210
208
152
206
200
204
212
210
212
210
210
202
212
212
203
210

220
154
222
222a
222a
224
224a
224a
222a
224a

MULTISTAGE PUMP

TECHNICAL FIELD OF THE INVENTION

The present invention relates generally to pumps, and in particular to multistage submersible pumps.

BACKGROUND OF THE INVENTION

Submersible pumps are used throughout the world to pump water out of various well configurations. The submersible pump typically has a plurality of impellers which work in series to develop pressure within the pump. The water is expelled from the pump discharge and is therefore pressurized and available for usage. In general, a submersible pump will incorporate a number of impellers, or stages, which may vary in their respective diameters and port openings. Such pumps are commonly referred to as multistage pumps.

Generally, the impellers of each stage of a multistage pump adds pressure to the water entering each stage. Accordingly, as the number of stages in a pump are increased, the pump's total output pressure also increases. A pump will, however, lose efficiency if water is re-circulated within a particular stage. For example, recirculated water diminishes the magnitude of the pressure entering the next stage in the series. In addition, recirculation may also severely decrease pump life if abrasive particles are passed into the pump and dwell in the stage.

What is needed is a multistage submersible pump that incorporates one or more seals on each impeller in order to prevent recirculation. What is further needed is a seal designed to ensure that recirculation within the stage is kept at a minimum and that any debris which may pass through the pump does not continue to recirculate within it. Thus, what is needed is a pump with an efficient sealing system that keeps recirculation to a minimum. There has also been a need for an improved thrust bearing and wear member configuration in centrifugal pumps. Still further, there has been a need for pump seal arrangements which will compensate for axial and lateral movement of the pump impellers due to thrust forces acting thereon.

SUMMARY OF THE INVENTION

The present invention is directed to an improved multistage centrifugal pump including a seal configuration providing for the reduction of fluid recirculation within the pump. In one preferred embodiment, the present invention comprises a pump including a pump stage having an impeller shaft and an impeller assembly, a disc assembly, a thrust washer and a diffuser assembly, all disposed about the impeller shaft. The impeller assembly has a first side (the impeller hub) and a second side (the impeller eye). The disc assembly is disposed adjacent to the impeller assembly on a first side of the impeller assembly. The diffuser assembly is disposed adjacent to the impeller assembly on a second side of the impeller assembly. The diffuser assembly preferably incorporates a diffuser, a hub seal and a retainer ring to secure the hub seal to the diffuser. A thrust washer is disposed in a planar relation to the diffuser hub seal.

The present invention also comprises a pump stage having an impeller shaft and an impeller assembly, a disc assembly and a diffuser assembly, all disposed about the impeller shaft. The impeller assembly incorporates an impeller disc on one side and an impeller on the other side thereof having spiral impeller blades. The disc assembly is disposed adjacent to the impeller assembly on the first side of the impeller assembly. The disc assembly preferably incorporates a disc, a wear ring and a retainer ring securing the wear ring to the disc. The diffuser assembly is disposed adjacent to the impeller assembly on the second side of the impeller assembly. The diffuser assembly preferably incorporates a diffuser, a hub seal and a retainer ring securing the hub seal to the diffuser for limited lateral movement.

Still further, the present invention comprises a pump including a motor, an impeller shaft operably connected to the motor, a pump body having an inlet end and an outlet end, an inlet port disposed at the inlet end of the pump body, an outlet port disposed at the outlet end of the pump body, an impeller shaft and two or more pump stages having an improved arrangement of interstage seals and members for transferring impeller thrust loads.

Still further in accordance with the invention, each pump stage preferably incorporates at least one impeller assembly, at least one disc assembly and at least one diffuser assembly, all disposed about an impeller shaft. At least one impeller assembly preferably incorporates an impeller disc on a first side and an impeller on a second side thereof having at least one spiral impeller blade. At least one disc assembly is preferably disposed adjacent to an impeller assembly on the first side of the impeller assembly. The disc assembly preferably incorporates a disc, a wear ring and a retainer ring securing the wear ring to the disc. At least one diffuser assembly is preferably disposed adjacent to the impeller assembly on the second side of the impeller assembly. At least one diffuser assembly preferably incorporates a diffuser, a hub seal and a retainer ring securing the hub seal to the diffuser.

Those skilled in the art will further appreciate the advantages and superior features of the invention upon reading the detailed description which follows in conjunction with the drawings.

DETAILED DESCRIPTION OF THE PREFERRED EMBODIMENTS

Although the making and using of certain embodiments of the present invention are discussed in detail below, it should be appreciated that the specific embodiments discussed herein are merely illustrative of ways to make and use the invention, and do not delimit the scope of the invention. The drawings are not necessarily to scale and certain features may be shown in generalized or schematic form.

Figure 1:
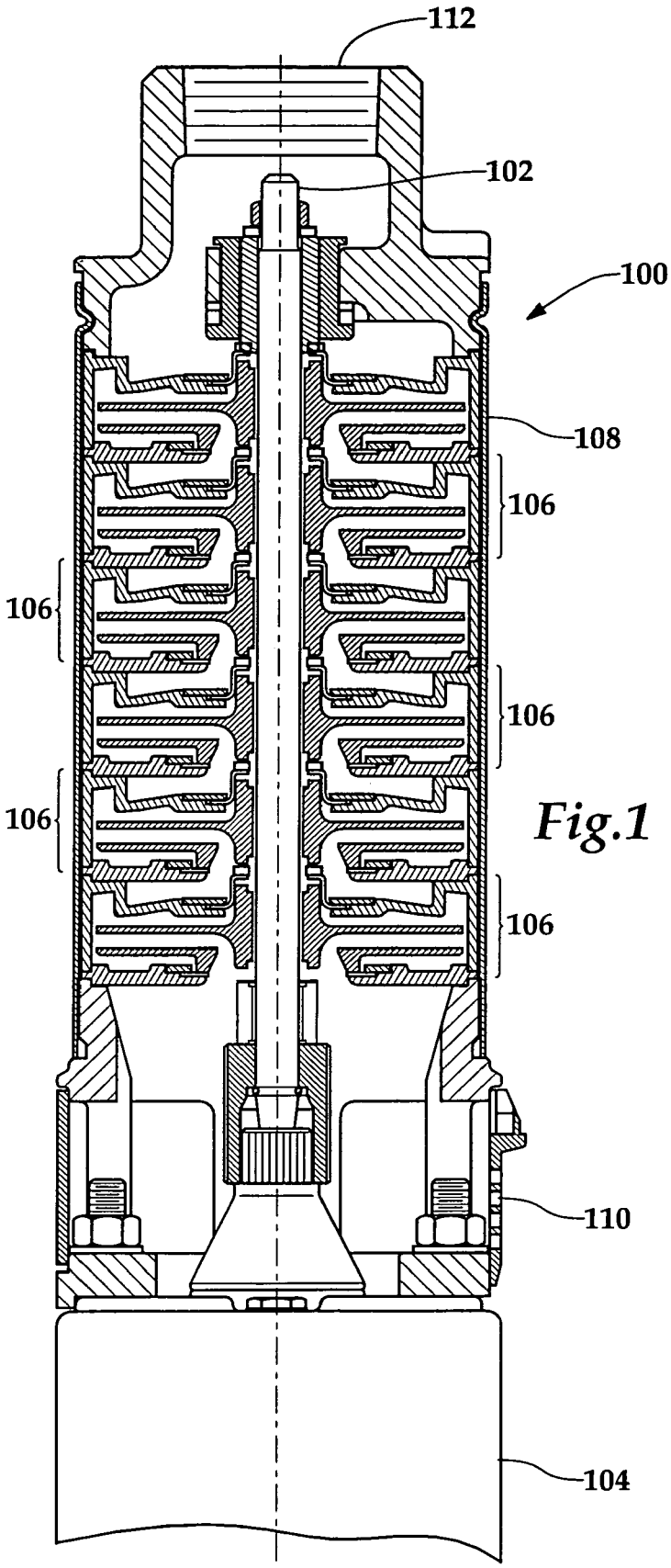
FIG. 1 is a longitudinal central section view of a multistage pump according to the present invention.

In one preferred embodiment, the present invention comprises a multistage pump assembly 100, as depicted in FIG. 1, having a main impeller shaft 102 rotatably driven by a motor 104. Preferably, plural pump stages 106 are disposed about main shaft 102 within a cylindrical pump case 108. The pump stages 106 driven by the main shaft 102 move fluid from a pump fluid inlet 110 to pump fluid outlet 112.

Each pump stage 106 comprises three sub-assemblies, as depicted in FIGS. 2 through 6. These sub-assemblies each comprise a diffuser assembly 150, an impeller assembly 152 and a disc assembly 154. When assembled, the diffuser assembly 150 and disc assembly 154 are fixed within and non-rotatable with respect to pump case 108, while impeller assembly 152 is secured to the main shaft 102 for rotation therewith and the main shaft rotates with respect to the diffuser assembly 150 and the disc assembly 154.

Figure 2:
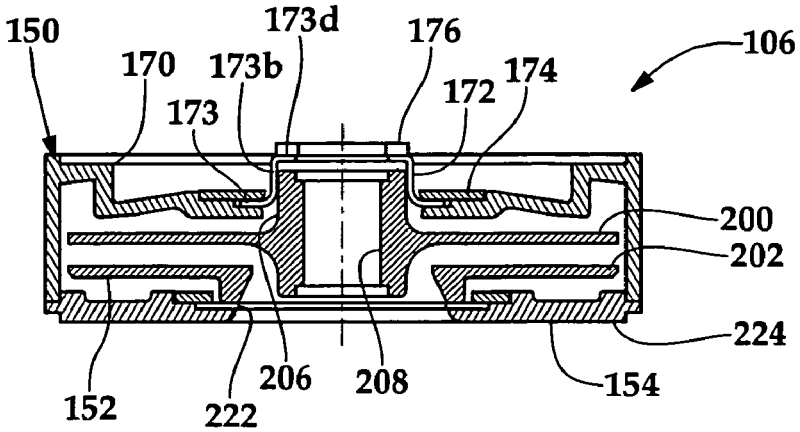
FIG. 2 is a detail longitudinal central section view of a pump stage of the pump shown in FIG. 1.
Figure 3:
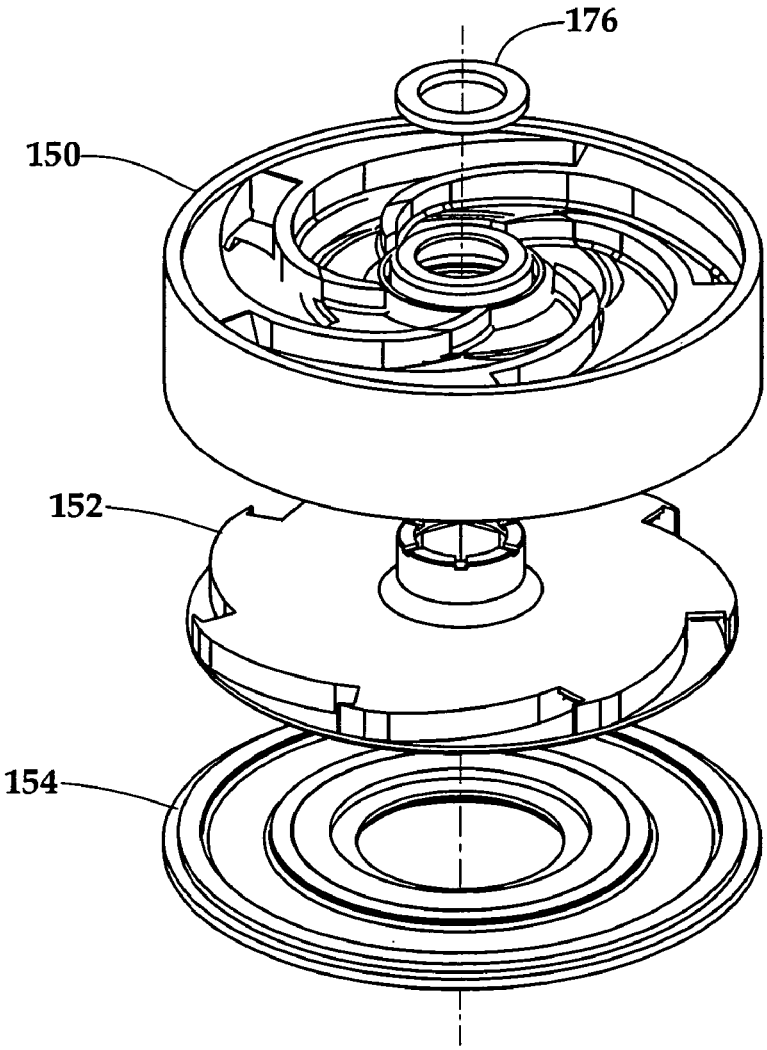
FIG. 3 is an exploded perspective view of the pump stage of FIG. 2.

As shown in FIG. 2, the diffuser assembly 150 of each stage 106 comprises a cylindrical diffuser body 170, a hub seal 172 mounted thereon, a retainer ring 174 and a thrust washer 176. Diffuser body 170 and retainer ring 174 may be made of polycarbonate or other suitable plastic. Hub seal 172 may be made of one of a variety of materials including, for example, stainless steel. Thrust washer 176 is preferably made of one of a variety of materials including, for example, carbon phenolic.

Figures 4, 5, 6:
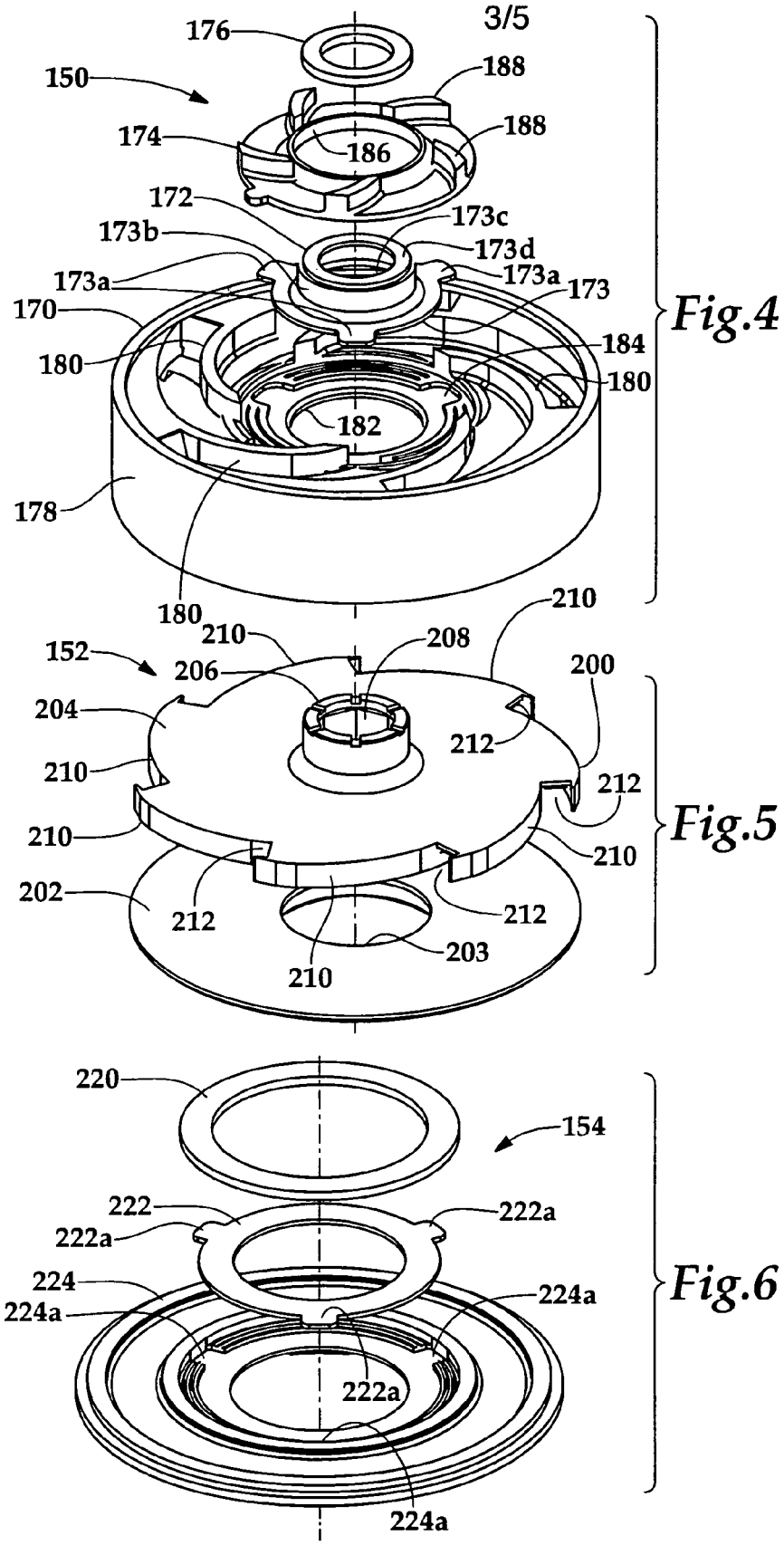
FIG. 4 is an exploded perspective view of the diffuser assembly of the pump stage of FIGS. 2 and 3.
FIG. 5 is an exploded perspective view of the impeller assembly of the pump stage of FIGS. 2 and 3.
FIG. 6 is an exploded perspective view of the disc assembly of the pump stage of FIGS. 2 and 3.

Now referring also to FIG. 4, the diffuser body 170 includes a generally-cylindrical outer wall 178 and an outer section including a set of one or more circumferentially spaced outer diffuser fins 180 extending along a somewhat spiral path from a main shaft opening 182 to the outer wall 178. Hub seal 172 is preferably characterized as a circular disk shaped member 173 having plural, circumferentially spaced radially projecting tabs 173*a* formed thereon and sized to fit into a cooperating lower hub seal seat 184 formed in the diffuser body 170 about the main shaft opening 182. Disc shaped member or flange 173 of seal 172 includes a cup shaped hub portion 173*b* having a circular opening 173*c* formed in transverse wall or face 173*d*. Retainer ring 174 includes a central bore 186 sized to fit closely around the hub portion 173*b* of the hub seal 172. Hub seal 172 is also disposed in seat 184 for limited lateral excursion with respect to shaft 102 and body 170. In at least one embodiment, retainer ring 174 may be secured to diffuser body 170 by, for example, sonic welding, although other appropriate securement methods will be apparent to those of skill in the art. Retainer ring 174 comprising an inner diffuser section may include diffuser fins 188 circumferentially spaced apart, extending radially from the bore 186 and adapted to be aligned with the outer diffuser fins 180 in the diffuser body 170.

Centrifugal closed impeller assembly 152, as depicted in FIG. 5, comprises an upper impeller body 200 and a lower impeller disc 202 having a fluid inlet opening or eye 203 formed therein. In at least one embodiment, upper impeller 200 and lower impeller disc 202 may be made of, for example, a polymer material, such as acetal. Upper impeller 200 comprises a generally-planar upper impeller disc part 204 disposed about a generally-cylindrical central hub 206. Central hub 206 includes, for example, a main shaft bore 208 and is preferably shaped and sized to receive main shaft 102 in close fitting relationship. A set of circumferentially spaced spiral impeller blades 210 extend generally from central hub 206 to the radial outermost edges of impeller disc 204. In certain embodiments, upper impeller 200 and lower impeller disc 202 may be secured to one another by sonic welding, although other appropriate securement methods will be apparent to those of skill in the art. Secured in this or another manner, impeller disc 204, impeller blades 210 and lower impeller disc 202 form plural impeller fluid flow passages 212.

Now referring to FIG. 6, disc assembly 154 preferably comprises a retainer ring 220, a wear ring 222 and a disc 224. Retainer ring 220 and disc 224 may be made of a variety of materials including, for example, polycarbonate or other suitable plastic. Wear ring 222 may be made of a variety of materials, including stainless steel. Wear ring 222 includes plural circumferentially spaced radially projecting tabs 222*a* which fit in cooperating recesses 224*a* formed in disc 224 for securing the wear ring non-rotatable with respect to the disc. Retainer ring 220 may be suitably secured to disc 224 by sonic welding to retain wear ring 222 secured on the disc.

Another preferred embodiment of the present invention, designated as centrifugal multistage pump assembly 300, is shown in FIGS. 7-10. Flow of fluid through pump assembly 300 is generally as indicated by the arrows and flow lines in FIG. 7. Pump assembly 300 includes a main shaft 302 rotatably driven by a motor (not shown). A set of plural pump stages 306 is disposed axially stacked about main shaft 302 within a cylindrical pump case 308. Driven by main shaft 302, pump stages 306 move fluid from pump inlet 310 to pump outlet 312. Pump assembly 300 is substantially the same as pump assembly 100, except pump assembly 300 includes only three stages including a first pump stage 314, instead of the six stages 106 shown for pump assembly 100.

Each pump stage 306 and 314 comprises three sub-assemblies. These sub-assemblies include a diffuser assembly 350, an impeller assembly 352 and a disc assembly 354, as shown for final pump stage 306 in FIG. 7. As assembled, diffuser assembly 350 and disc assembly 354 are fixed within and non-rotatable with respect to pump case 308, while each impeller assembly 352 is suitably secured to the main shaft 302 such that it rotates with the main shaft and with respect to diffuser assembly 350 and disc assembly 354.

Diffuser assembly 350 includes a diffuser body 370, a hub seal 372, a retainer ring 374 and a thrust washer 376. Diffuser body 370 and retainer ring 374 may be made of polycarbonate or other suitable plastic. Hub seal 372 is preferably made of one of a variety of materials, including stainless steel. Thrust washer 376 may also be made of one of a variety of materials including, for example, carbon phenolic.

Figure 8:
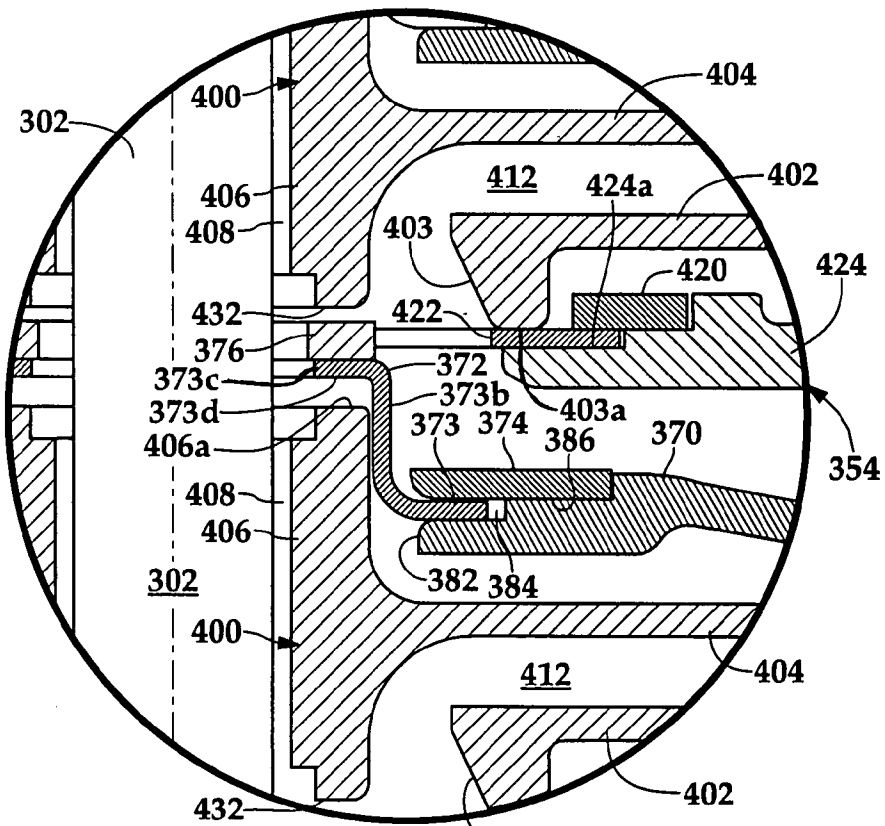
FIG. 8 is a detail section view on a larger scale showing the portion of a pump stage taken within the dashed line circle 8-8 of FIG. 7.

In a similar manner to that described above for diffuser body 170, diffuser body 370 includes a generally-cylindrical outer section including an outer wall and a set of one or more outer diffuser fins extending radially from the main shaft passage 382 to the outer wall. In fact, the components of pump stages 306 and 314 may be identical to the components of the pump stages 106 previously described. As shown in FIG. 8, portion of hub seal 372 is shaped and sized to fit into a hub seal recess or seat 384 formed in the diffuser body 370 about the main shaft passage 382. Hub seal 372 includes a disc shaped flange part or member 373 integrally formed with a cylindrical cup shaped hub part 373*b* and a transverse wall or face 373*d* delimited by a cylindrical shaft opening 373*c*, FIG. 8. Retainer ring 374 is secured to diffuser body 370 and a surface 386 of retainer ring 374 engages flange 373 of the hub seal 372 to retain the hub seal in the seat 384 for limited lateral excursion with respect to shaft 302 and body 370. Retainer ring 374 is secured to diffuser body 370 by sonic welding, although other appropriate securement methods will be apparent to those of skill in the art. Retainer ring 374 may incorporate one or more inner diffuser fins, not shown, extending radially from the side of ring 374 opposite the surface or side 386, and aligned with the diffuser fins in the diffuser body 370.

Impeller assembly 352 is composed of upper impeller member 400 and lower impeller disc 402 including a cylindrical fluid inlet opening or eye 403, FIG. 8. Inlet opening 403 is delimited by an annular eye portion of disc 402 forming a transverse, annular, wear or bearing surface 403*a*, FIGS. 8 and 10, engageable with a wear ring 422. Upper impeller 400 and lower impeller disc 402 may be made of a polymer, such as acetal. Each upper impeller member 400 includes a generally-planar impeller disc 404 disposed about a generally-cylindrical central hub 406 operable to be suitably secured to shaft 302 for rotation therewith. Central hub 406 includes a main shaft bore 408 shaped and sized to receive main shaft 302. Cylindrical cup shaped hub part 373*b* of seal 372 is dimensioned to be in close fitting relationship to cylindrical hub 406 and may engage with hub 406 if the impeller assembly 352 undergoes lateral movement. Impeller assembly 352 includes a set of impeller blades, not shown, which extend generally radially from central hub 406 to the outermost edges of upper impeller disc 404 and configured generally like impeller assembly 152. Upper impeller member 400 and lower impeller disc 402 may also be secured to one another by sonic welding. Secured in this or another manner, upper impeller disc 404 and lower impeller disc 402 form a set of one or more impeller passages 412, FIG. 8. Impeller assembly 352 may be substantially like impeller assembly 152.

Each disc assembly 354 comprises a retainer ring 420, the wear ring 422 and a disc member 424. Retainer ring 420 and disc 424 may be made of one of a variety of materials including polycarbonate or other suitable plastic. Wear ring 422 may be made of stainless steel. Retainer ring 420 may be secured to disc 424 by sonic welding to secure wear ring 422 in annular recess 424*a*, although other appropriate securement methods will be apparent to those of skill in the art.

Figure 7:
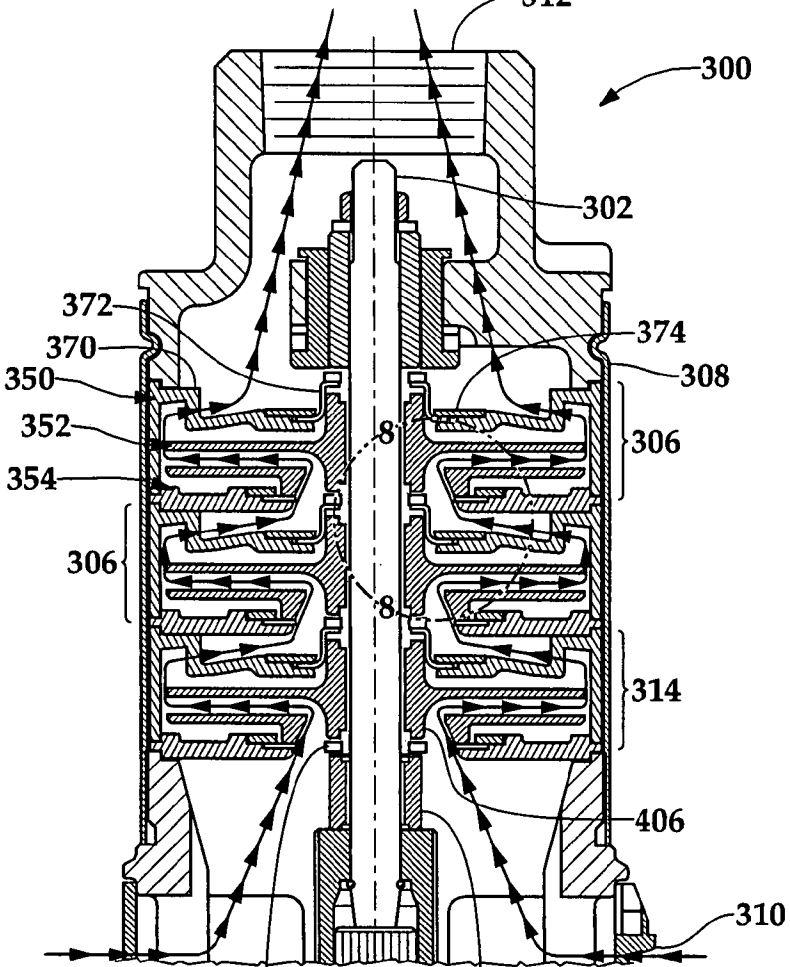
FIG. 7 is a longitudinal central section view of a multistage pump in a first condition of operation and showing the path of fluid flow through the pump stages.

Constructed as shown in FIGS. 7-10 and described above, pump assembly 300 is designed to maintain adequate sealing throughout its useful life. When new, the components of pump assembly 300 are disposed substantially as shown in FIGS. 7 and 8. Hub seal 372 provides a radial seal centering itself on hub 406, as shown in FIG. 8 and, being at least slightly loosely retained in seat 384, may undergo limited "float" or movement radially or laterally with lateral excursion of impeller hub 406. Seal 372 provides a substantial fluid seal between adjacent pump stages to minimize fluid recirculation between stages. Wear ring 422 absorbs thrust loads imposed on the impeller assembly 352. Washer 376 is adapted for limited axial float to provide a secondary seal at shaft 302 between seal wall or face 373*d* and sealing edge or face 432 of the adjacent impeller, FIG. 8. Reverse thrust loads on impeller assembly 352 are taken from transverse impeller hub surface 406*a*, FIGS. 8 and 10, engaging transverse face 373*d*, and these loads are transferred from hub seal 372 to diffuser body 370 and retainer ring 374.

Figure 10:
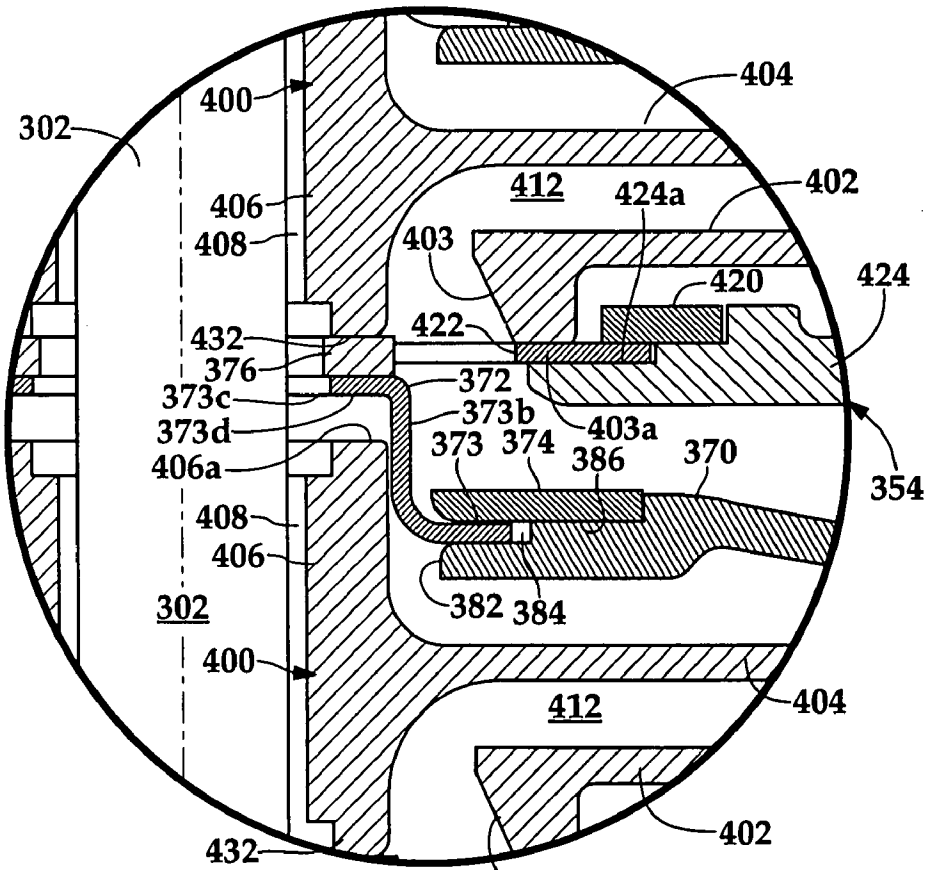
FIG. 10 is a detail section view on a larger scale at the second condition of operation and taken within the dashed line circle 10-10 of FIG. 9.
Figure 9:
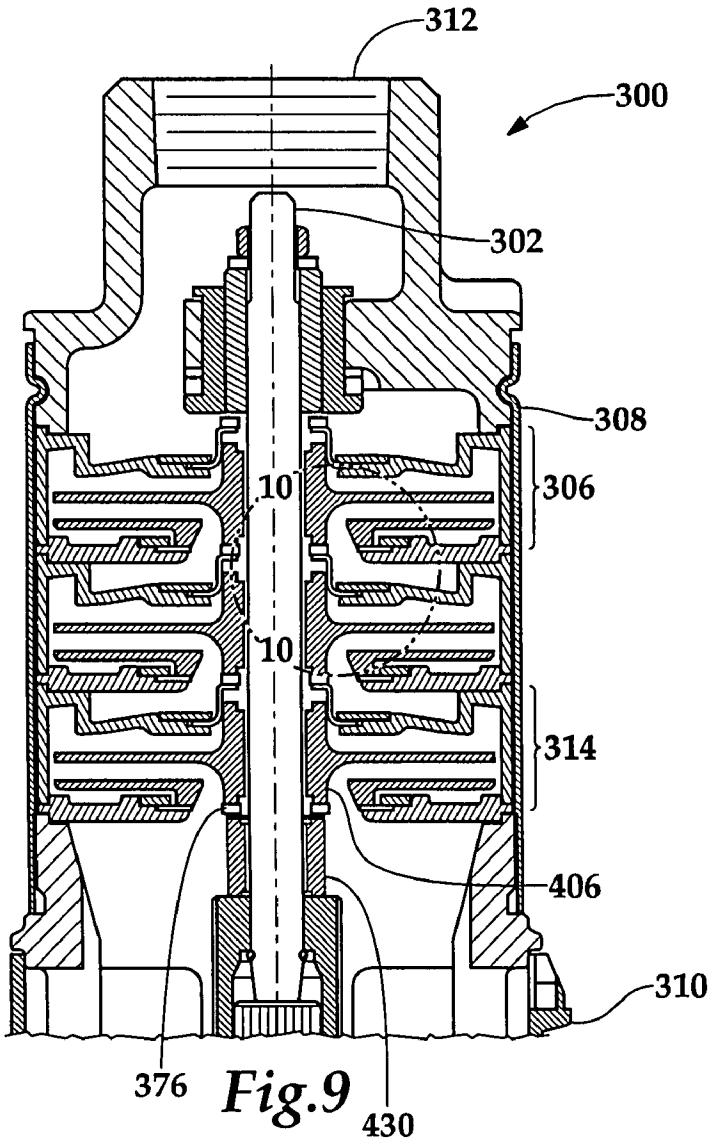
FIG. 9 is a longitudinal central section view of the multi-stage pump of FIG. 7 at a second condition of operation.

As the pump assembly 300 wears, the arrangement of the above-described components of the pump assembly 300 moves generally from that shown in FIGS. 7 and 8 to that shown in FIGS. 9 and 10. Over time, lower impeller disc 402 tends to wear at surface 403*a* against wear ring 422. Wearing of the lower impeller disc 402, and possibly the wear ring 422 also, allows the sealing face 432 of impeller 400 to move closer to and engage the washer 376 disposed adjacent to the hub seal 372 of an adjacent pump stage 306. As an impeller 400 moves into contact with thrust washer 376, at least some thrust load on wear ring 422 is taken up by the non-rotating hub seal 372, which reduces further wear of the impeller disc 402 and provides a new or secondary hub seal. The inlet pump stage 314 of pump assembly 300 relies on an annular spacer bearing 430, FIG. 7, to take thrust loads from impeller hub 406 and a washer 376 to inhibit impeller eye wear, since stage 314 does not have a pump stage 306 behind it (below, viewing the drawing figures) to support the thrust washer 376.

The specific embodiments discussed herein are merely illustrative of specific ways to make and use the invention, and do not delimit the scope of the invention. Those skilled in the art will recognize that various substitutions and modifications may be made to the invention without departing from the scope and spirit of the appended claims.

What is claimed is:

1. A pump stage in a centrifugal pump comprising:

an impeller shaft;

an impeller assembly having a first side and a second side disposed about the impeller shaft;

a disc assembly disposed about the impeller shaft adjacent to the impeller assembly on the first side of the impeller assembly;

a diffuser assembly disposed about the impeller shaft adjacent to the impeller assembly on the second side of the impeller assembly;

a diffuser hub seal disposed adjacent to the diffuser assembly, wherein the diffuser hub seal is further disposed to seal the second side of the impeller assembly; and a thrust washer disposed about the impeller shaft and adjacent to the diffuser hub seal, having a first surface facing a first generally-planar sealing face of the diffuser hub seal.

2. The pump stage of claim 1, wherein the diffuser assembly comprises an outer diffuser section and an inner diffuser section.

3. The pump stage of claim 2, wherein the inner diffuser section is adapted to secure the diffuser hub seal for limited lateral movement with respect to the diffuser assembly.

4. The pump stage of claim 2, wherein the outer diffuser section comprises at least one outer diffuser fin.

5. The pump stage of claim 2, wherein at least one outer diffuser fin has a spiral shape.

6. The pump stage of claim 2, wherein the inner diffuser section comprises at least one inner diffuser fin.

7. The pump stage of claim 6, wherein at least one inner diffuser fin has a spiral shape.

8. The pump stage of claim 2, wherein the inner diffuser section includes a retainer ring, and wherein the retainer ring secures the hub seal to the outer diffuser section.

9. A pump stage in a multistage centrifugal pump comprising:

an impeller shaft;

an impeller assembly, disposed about the impeller shaft, comprising:

an impeller disc on a first side thereof; and an impeller on a second side thereof having at least one spiral impeller blade;

a disc assembly disposed about the impeller shaft adjacent to the impeller assembly on the first side of the impeller assembly, comprising:

a disc;

a wear ring; and a first retainer ring securing the wear ring to the disc; and a diffuser assembly disposed about the impeller shaft adjacent to the impeller assembly on the second side of the impeller assembly, comprising:

a diffuser;

a hub seal; and a second retainer ring securing the hub seal to the diffuser.

10. The pump stage of claim 9, wherein the impeller comprises at least one impeller blade.

11. The pump stage of claim 10, wherein at least one impeller blade has a spiral shape.

12. The pump stage of claim 9, wherein the impeller disc has a generally-planar axial sealing surface disposed to the first side of the impeller assembly.

13. The pump stage of claim 12, wherein the generally-planar axial sealing surface is mated to the wear ring.

14. The pump stage of claim 9, wherein the hub seal has a generally-cylindrical inner surface.

15. The pump stage of claim 9, wherein the impeller has a generally-cylindrical hub surface and wherein the generally-cylindrical inner surface of the hub seal is mated to the generally-cylindrical hub surface of the impeller.

16. The pump stage of claim 9, wherein the hub seal has a generally-planar axial sealing surface.

17. The pump stage of claim 16 further comprising a washer, having at least one generally-planar sealing surface, disposed about the impeller shaft adjacent to the hub seal, and wherein the generally-planar axial sealing surface of the hub seal is mated to the generally-planar sealing surface of the washer.

18. A multistage centrifugal pump comprising:

a drive shaft disposed within a pump case and plural pump stages disposed within said case and operably connected to said drive shaft, at least one of said pump stages comprising a stationary diffuser assembly, a rotatable impeller assembly secured for rotation with said drive shaft and a stationary disc assembly, said impeller assembly including a hub part having a transverse hub face formed thereon, a hub seal comprising a radially extending flange part, a seal hub part and a transverse face having an opening therein for receiving said drive shaft, said hub seal being secured to said diffuser assembly for locating said seal hub part in close fitting relation to said hub part of said impeller assembly, a thrust washer engageable with said transverse face of said hub seal and with a transverse face of an impeller assembly of an adjacent pump stage, said hub seal and said thrust washer forming a seal between adjacent pump stages to limit fluid recirculation therebetween.

19. The pump set forth in claim 18 including:

a wear ring mounted on said disc assembly and engageable with a wear face of said impeller assembly, the dimensional relationships of said wear ring, said impeller assembly, said hub seal and said thrust washer being such that, as wear occurs at one of said impeller assembly and said wear ring, said hub face of said impeller assembly is engageable with said thrust washer to form a fluid seal.

20. The pump set forth in claim 18 wherein:

said hub seal is secured to said diffuser assembly for limited lateral movement with respect to said diffuser assembly.

* * * * *